US006974298B2

(12) United States Patent
Tanaka

(10) Patent No.: US 6,974,298 B2
(45) Date of Patent: Dec. 13, 2005

(54) LENS STOCKING APPARATUS AND LENS PROCESSING SYSTEM HAVING THE SAME

(75) Inventor: Motoshi Tanaka, Aichi (JP)

(73) Assignee: Nidek Co., Ltd., Aichi (JP)

( * ) Notice: Subject to any disclaimer, the term of this patent is extended or adjusted under 35 U.S.C. 154(b) by 13 days.

(21) Appl. No.: 10/834,042

(22) Filed: Apr. 29, 2004

(65) Prior Publication Data

US 2004/0219005 A1 Nov. 4, 2004

(30) Foreign Application Priority Data

Apr. 30, 2003 (JP) ..... P2003-125545

(51) Int. Cl.[7] ..... B65B 35/50; G02B 21/06

(52) U.S. Cl. ..... 414/788.1; 414/793.8; 451/5; 451/43

(58) Field of Search ..... 414/788.1, 793.8; 451/5, 43

(56) References Cited

U.S. PATENT DOCUMENTS 5,967,879 A 10/1999 Gottschald
6,152,678 A 11/2000 King
6,159,072 A 12/2000 Shibata
6,913,510 B2 * 7/2005 Mizuno et al. ..... 451/5
2004/0018801 A1 1/2004 Mizun et al.
2004/0029496 A1 * 2/2004 Mizuno et al. ..... 451/43

FOREIGN PATENT DOCUMENTS

DE 100 13 648 A1 9/2001
EP 0 798 076 A1 10/1997
EP 1375065 A1 1/2004
WO WO 01/70460 A1 9/2001

* cited by examiner

*Primary Examiner*—Evelyn A. Lester
(74) *Attorney, Agent, or Firm*—Sughrue Mion, PLLC

(57) ABSTRACT

A lens stocking apparatus for stocking lenses includes: a first stage and a second stage, each of which can stack lens accommodating trays in a vertical direction; vertical movement mechanism portions which move the first and second stages in the vertical direction, respectively; and a tray transferring unit which transfers the trays from the first stage to the second stage. The tray transferring unit includes right and left hands for holding the tray which can independently move in a transverse direction. When the tray is transferred from the first stage to the second stage, the tray transferring unit moves the right and left hands in a approaching direction to hold the tray, moves the right and left hands in a direction from the first stage to the second stage to transfer the tray, and moves the first and second hands in a departing direction to releases the tray.

10 Claims, 9 Drawing Sheets

LENS STOCKING APPARATUS AND LENS PROCESSING SYSTEM HAVING THE SAME

BACKGROUND OF THE INVENTION

The present invention relates to a lens processing system for processing a lens and a lens stocking apparatus for stocking lenses.

In eyeglass lenses, for example, the processing of lenses, which has conventionally been performed individually at optician's shops, has in recent years come to be performed intensively at a processing center. In the processing center, a multiplicity of lenses are processed intensively in response to orders from optician's shops. In this intensive processing, it is desired that labor saving (automation) be attained as practically as possible in a series of steps related to lens processing. For this reason, a lens stocking apparatus and a lens processing system having the same has been proposed in which an unprocessed lens is taken out from a lens accommodating tray or the like, is conveyed, and is set in a lens processing apparatus, and a processed lens is taken out from the processing apparatus, is conveyed, and is placed (returned) on the tray or the like, which is disclosed in EP-1375065-A1 filed by the present applicant, for example, reference is had to be made to this publication for details.

SUMMARY OF THE INVENTION

It is an object of the invention to provide a lens stocking apparatus that can be operated easily and has a simplified construction and a lens processing system having the lens stocking apparatus.

To accomplish the object described above, the invention employs the following construction.

(1) A lens stocking apparatus for stocking a plurality of lenses comprising:

a first stage and a second stage, each of which is capable of stacking a plurality of lens accommodating trays in a vertical direction;

vertical movement mechanism portions which move the first and second stages in the vertical direction, respectively; and a tray transferring unit which transfers the trays from the first stage to the second stage, wherein the tray transferring unit includes a right hand and a left hand for holding the tray, each of which is capable pf independently moving in a transverse direction, wherein when the tray is to be transferred from the first stage to the second stage, the tray transferring unit moves the right and left hands in a mutually approaching direction to hold the tray, moves the right and left hands in a direction from the first stage to the second stage to transfer the held tray, and moves the first and second hands in a mutually departing direction to releases the held tray.

(2) The lens stocking apparatus according to (1), wherein the tray transferring unit includes a first transverse movement mechanism portion having a first motor for moving the right hand in the transverse direction and a second transverse movement mechanism portion having a second motor for moving the left hand in the transverse direction.

(3) The stocking apparatus according to (1) further comprising a height adjustment unit which adjusts a height of at least one of the first and second stages in the vertical direction.

(4) The stocking apparatus according to (3), wherein the height adjustment unit includes a setting unit which sets a height and the vertical movement mechanism portion moves at least one of the first and second stages in the vertical direction on the basis of the set height.

(5) The stocking apparatus according to (4), wherein the height adjustment unit includes a storage unit which stores the set height, and the vertical movement mechanism portion moves at least one of the first and second stages on the basis of the stored height.

(6) The stocking apparatus according to (1) further comprising a detection unit which detects abnormality of a holding state or putting state of said trays.

(7) A lens processing system including the stocking apparatus according to (1), comprising:

a lens processing apparatus (100); and a lens conveying device (200) which conveys the lenses between the stocking apparatus and the processing apparatus.

(8) A lens stocking apparatus for stocking a plurality of lenses comprising:

a stage which is capable of stacking a plurality of lens accommodating trays in a vertical direction;

a setting unit which sets a height of the stage in the vertical direction; and a vertical movement mechanism portion which moves the stage in the vertical direction on the basis of the set height.

(9) The lens stocking apparatus according to (8) further comprising a storage unit which stores the set height, wherein the vertical movement mechanism portion moves the stage on the basis of the stored height.

(10). A lens processing system having the lens stocking apparatus according to (8), comprising:

a lens processing apparatus; and a lens conveying device which conveys the lenses between the stocking apparatus and the processing apparatus.

DETAILED DESCRIPTION OF PREFERRED EMBODIMENTS

Figure 1:
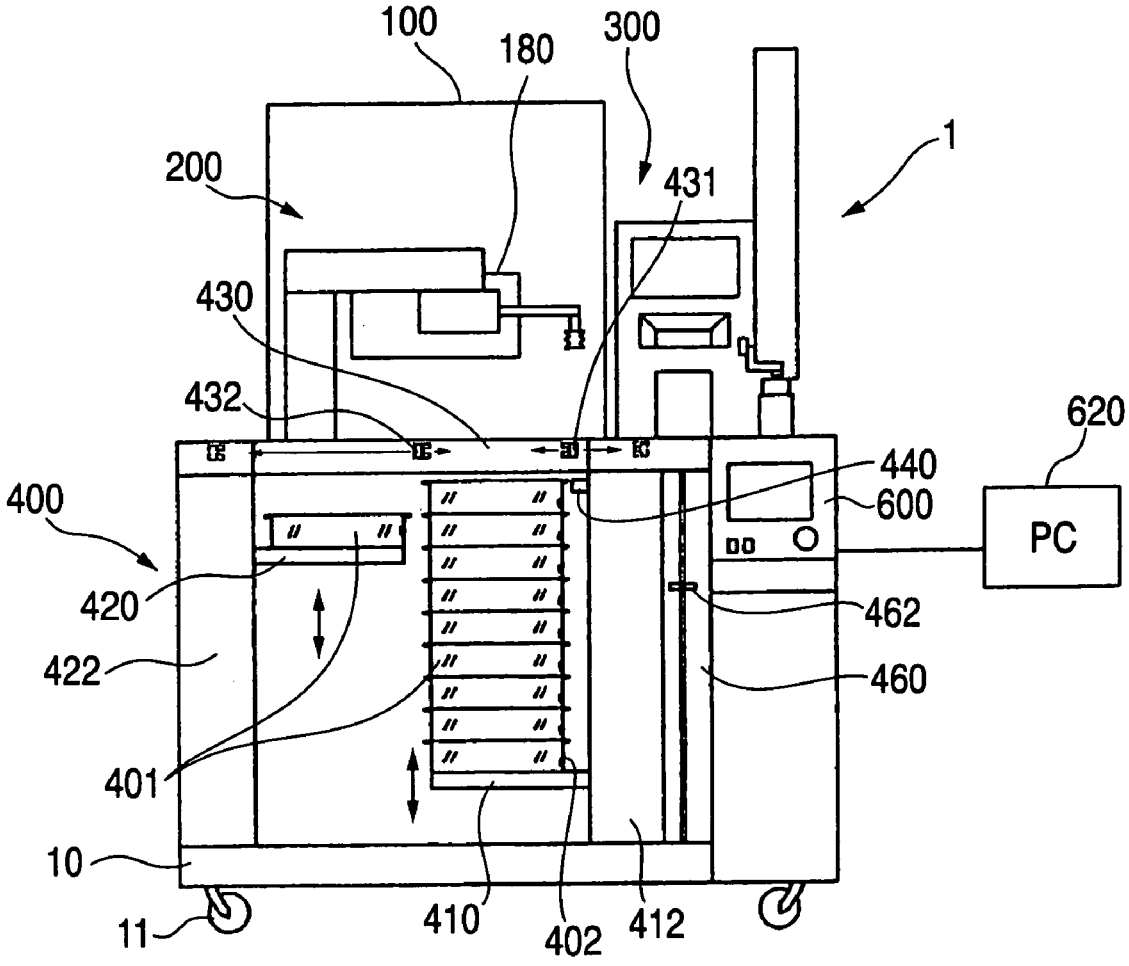
FIG. 1 is a schematic front elevational view of an eyeglass lens processing system in accordance with the invention.
Figure 2:
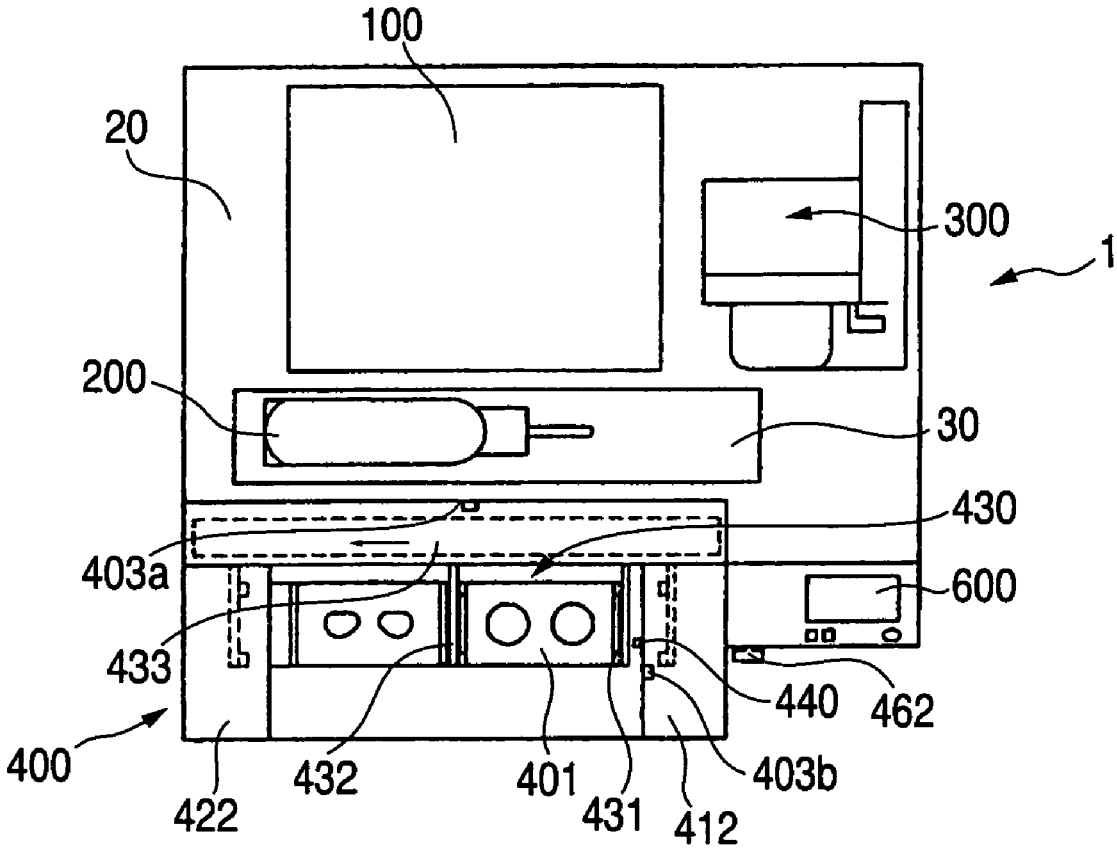
FIG. 2 is a schematic plan view, as taken from above, of the eyeglass lens processing system.

Referring now to the accompanying drawings, a description will be given of a first embodiment of the invention. FIG. 1 is a schematic front elevational view of an eyeglass lens processing system 1 in accordance with the invention. FIG. 2 is a schematic plan view, as taken from above, of the eyeglass lens processing system 1.

The eyeglass lens processing system 1 includes a lens processing apparatus 100 for processing an eyeglass lens LE; a robot hand device (RH device) 200 for conveying the lens LE; a blocking device 300 for attaching a cup serving as a processing jig to the lens LE; a tray (lens) stocking apparatus 400 for stocking lens accommodating trays 401 each adapted to accommodate a pair of left and right lenses LE; and a system control portion (unit) 600 for controlling the various devices and apparatuses. The system control portion 600 is connected to a host computer (host PC) 620 for managing ordering data.

The respective devices and apparatuses are mounted on a base 10 through a table 20. Castors 11 are fitted to the base 10 to allow the overall processing system 1 (devices and apparatuses) to be integrally movable. In addition, a circulation-type tank in which the processing water used by the processing apparatus 100 during processing is stored is accommodated below (inside) the table 20. The processing water stored in the tank is pumped up by a pump, and is supplied to the processing apparatus 100.

The processing apparatus 100 and the blocking device 300 are installed in such a manner as to be arranged side by side on the table 20. The RH device 200 moves along a straight movement path 30 extending in parallel from the processing apparatus 100 to the blocking device 300. The stocking apparatus 400 is installed in such a manner as to be arranged in front side of the processing apparatus 100 with the movement path 30 located therebetween. By virtue of the layout of installation of these devices, the state of progress of lens processing is made easy for an operator to observe.

Next, a description will be given of each device and apparatus provided in the processing system 1. Incidentally, since the blocking device 300 has little relevant to the present invention, the description thereof is omitted.

<Lens Processing Apparatus>

Figure 3:
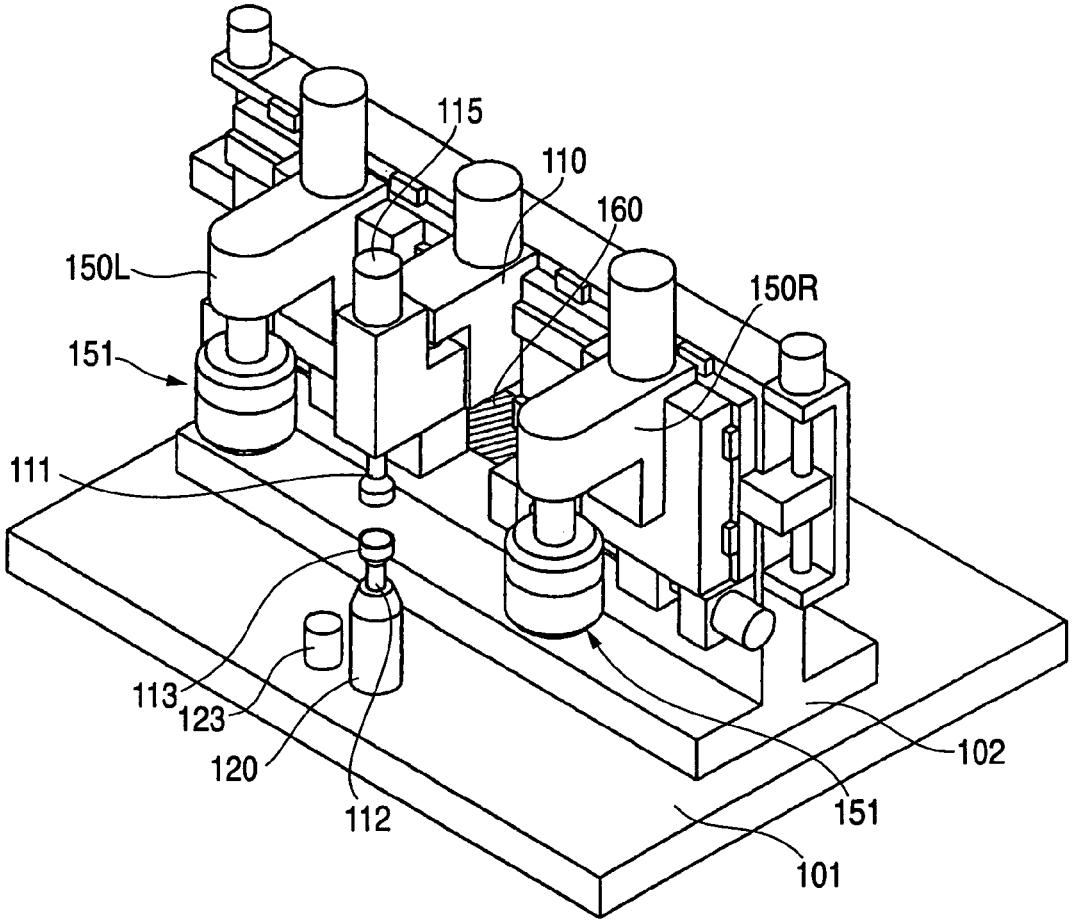
FIG. 3 is a schematic diagram of a lens processing apparatus.

FIG. 3 is a schematic diagram of the processing apparatus 100. The processing apparatus 100 clamps and holds the lens LE by a chuck shaft 111 and a chuck shaft 112 which extend vertically. The upper chuck shaft 111 is moved in the vertical (up-and-down) direction by a vertically moving mechanism part 110 provided at the center of a sub-base 102, and is rotated by a motor 115. The lower chuck shaft 112 is rotatably held by a holder 120 fixed to a main base 101, and is rotated in synchronism with the chuck shaft 111 by a motor 123.

Figure 4:
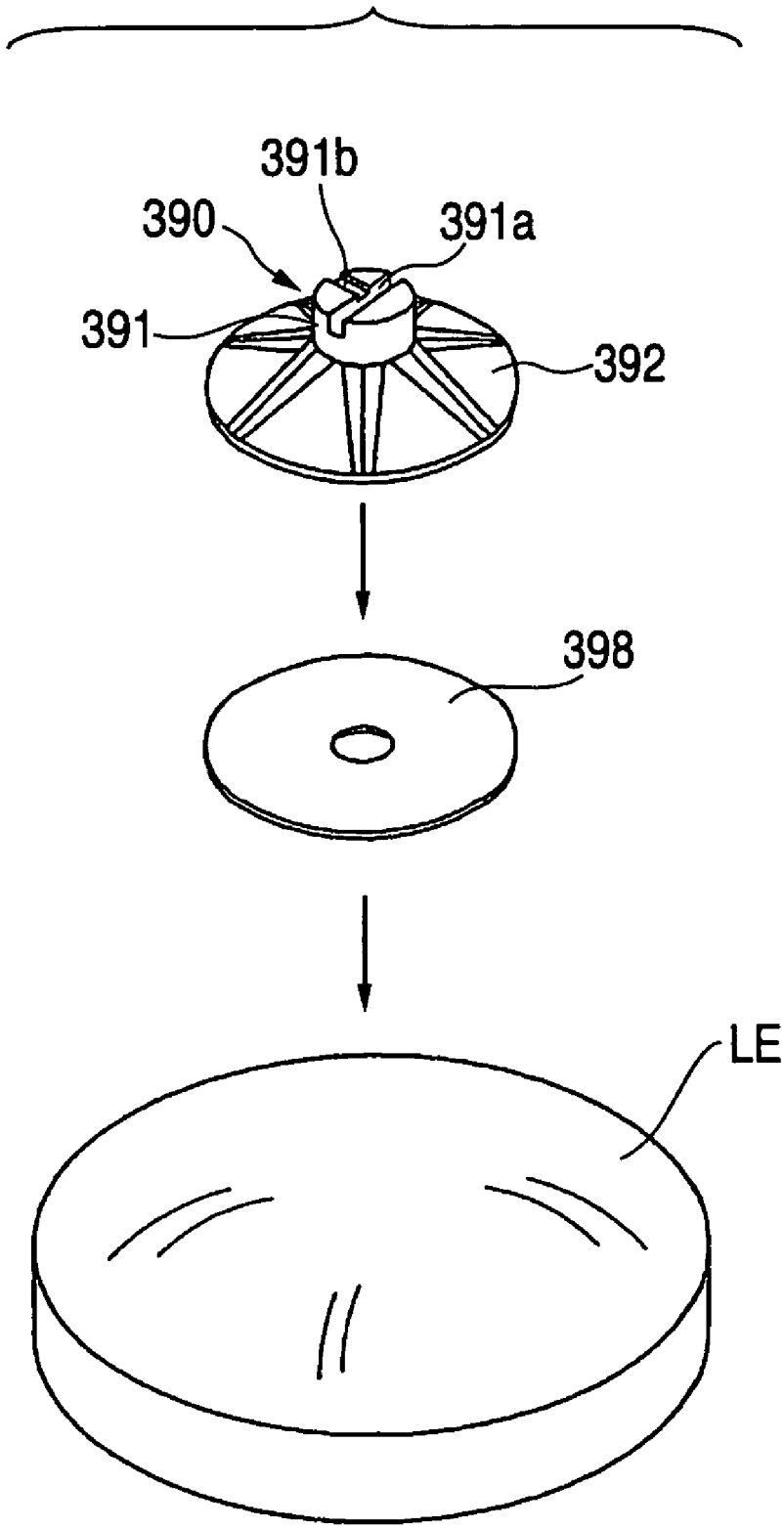
FIG. 4 is a diagram illustrating a schematic construction of a cup and the attachment of the cup to a lens.

To hold the lens LE by the chuck shafts 111 and 112, a cup 390, i.e., a processing jig, is attached in advance to the lens LE by an adhesive pad 398, as shown in FIG. 4. The cup 390 is automatically attached by the blocking device 300. The cup 390 has a cylindrical base portion 391 and a flared collar portion 392. A transverse keyway 391*a* and a vertical keyway 391*b* for determining a vertical direction at the time of attaching the lens LE (which direction refers to a vertical direction when the eyeglasses is worn) are formed in the base portion 391. Meanwhile, a cup holder 113 into which the base portion 391 of the cup 390 is inserted is fitted to the chuck shaft 112.

The lens LE held by the chuck shafts 111 and 112 is processed from two directions by grinding parts 150R and 150L each having grinding wheels 151 on the respective rotating shaft. The grinding parts 150R and 150L are bilaterally symmetrical, and are respectively moved in the vertical (up-and-down) and transverse (left-and-right) directions by moving mechanism parts provided on the sub-base 102.

A lens-shape measuring part 160 is accommodated on a farther side of the center of the sub-base 102. In addition, during the lens processing, the processing water stored in the tanks is sprayed onto the processing portions of the lens LE from unillustrated nozzles. In FIG. 1, reference numeral 180 denotes a window of a processing chamber.

It should be noted that the configuration of this grinding apparatus 100 is basically similar to that of JP-A-9-253999 (U.S. Pat. No. 5,716,256), so that reference is made thereto.

<RH Device>

Figure 5:
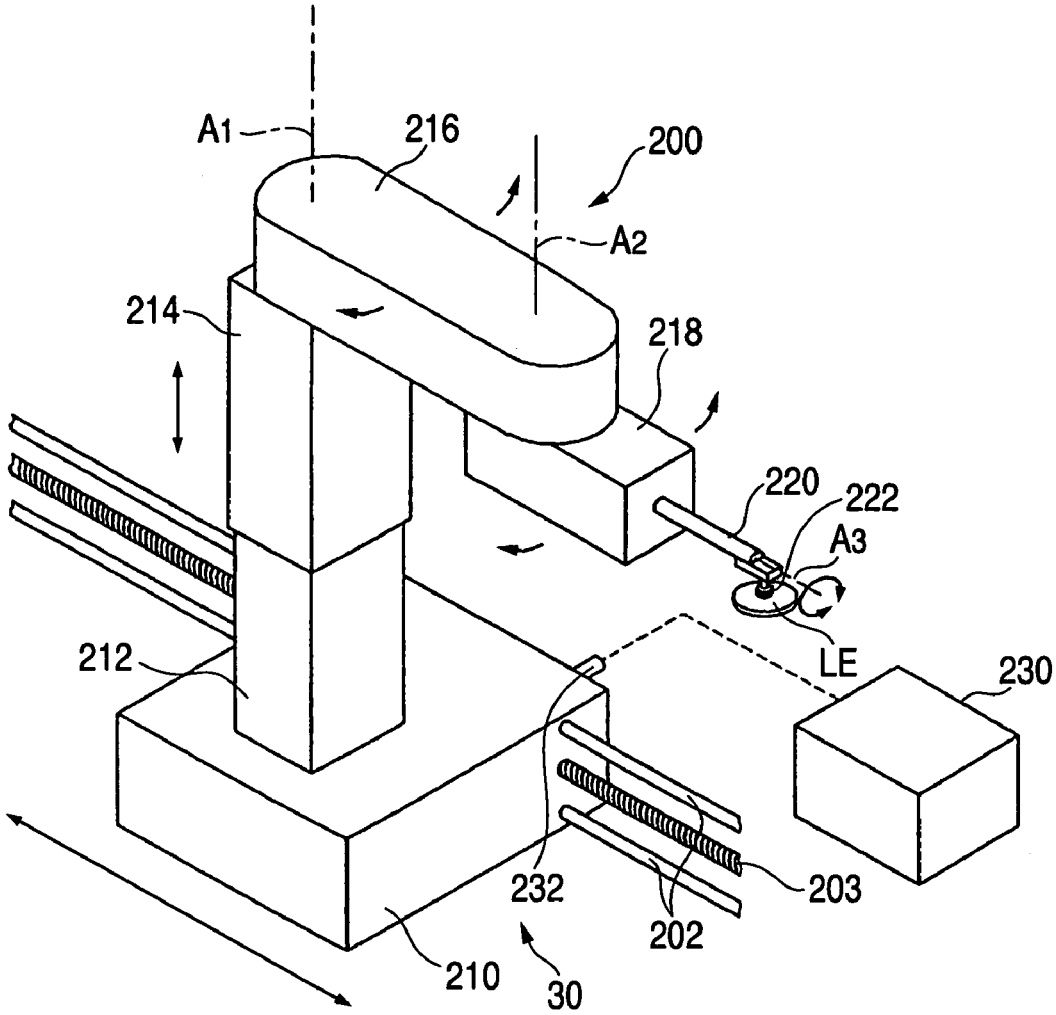
FIG. 5 is a schematic diagram of a robot hand device.

FIG. 5 is a schematic diagram of the RH device 200. As a ball screw 203 is rotated, a traversing base 210 is moved along two rails 202 extending in the direction of the movement path 30. A base portion 212 is fitted on the traversing base 210. A vertically sliding portion 214 is fitted to the base portion 212 in such a manner as to be vertically movable (slidable). A first arm 216, which rotates about a vertical axis A1, is fitted to an upper portion of the vertically sliding portion 214. A second arm 218, which rotates about a vertical axis A2, is fitted to a lower portion of a distal end of the first arm 216. A third arm 220, which rotates about a horizontal axis A3, is fitted to a distal end of the second arm 218. A sucking portion 222 for sucking and holding the lens LE is provided on the lower side of a distal end of the third arm 220.

Passages where air passes are respectively formed in the sucking portion 222, and these passages communicate with a tube 232 connected to an air pump 230. The tube 232 is passed through the traversing base 210, the base portion 212, the vertically sliding portion 214, the first arm 216, and the second arm 218. As the air pump 230 is driven, the lens LE is sucked and held. Further, as the driving of the air pump 230 is stopped to return the suction force to the level of the atmospheric pressure, the suction of the lens LE is canceled.

<Tray (Lens) Stocking Apparatus>

In FIGS. 1 and 2, the stocking apparatus 400 has a stage 410 (transferring stage) and a stage 420 (receiving stage) for placing the trays 401 thereon by being stacked vertically. The stages 410 and 420 are respectively moved vertically by vertical movement of mechanism portions 412 and 422. The trays 401 can be loaded on the stages 410 and 420 by being stacked vertically, and 10 trays 401 can be loaded on the respective stages. A hand portion 430 for holding the tray 401 includes a right hand 431 and a left hand 432. The right hand 431 and the left hand 432 are driven by a transverse movement mechanism portion 433 in such a manner as to approach toward and move (depart) away from each other and to move in the same direction between the stage 410 and the stage 420. A tray detection portion 403 is so constituted as to detect whether or not the uppermost tray 401 of the stacked trays stacked exists at the holding position of the hand portion 430. When the tray 401 at the holding position cuts off the rays of light from a light emission portion 403*a* disposed at the center of the depth of the stocking apparatus 400, a light reception portion 403*b* cannot receive the rays of light and the system control portion 600 can detect from an output signal from the light reception portion 403*b* whether or not the uppermost trays 401 exist at the holding position.

When an operator exchanges the trays 401, an adjustment knob 462 is used to adjust the height of the stage 410. A latch, not shown, is disposed inside the knob 462 and can fix the stage 410 at an arbitrary height. It is also possible to use a setting screw for fixing in place of the knob 462.

Figure 6:
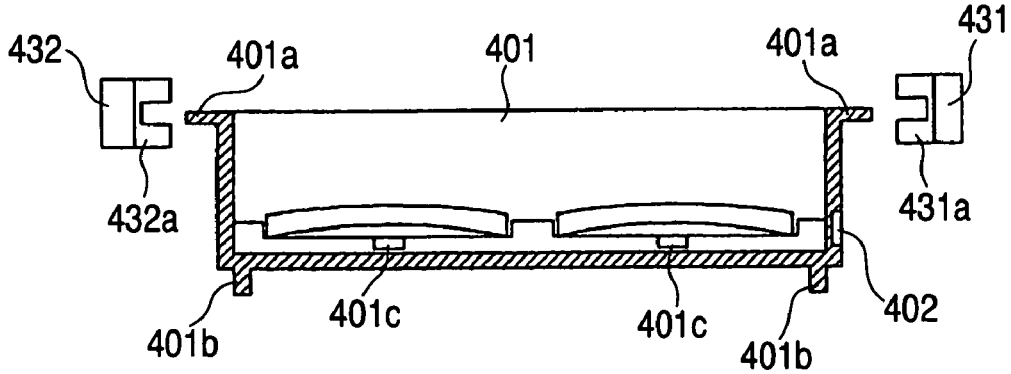
FIG. 6 is a schematic sectional view useful for explaining a holding mechanism of a hand portion for holding a tray.

FIG. 6 is a schematic sectional view for explaining a holding mechanism of the hand portion 430 for holding the trays 401. Flanges 401*a* protrude from the side surfaces of each tray 401 at the upper part of the tray 401. On the other hand, recesses 431*a* and 432*a* engaging respectively with the flanges 401*a* are provided to the right and left hands 431 and 432. When the tray 401 is held and conveyed by the hand portion 430, the tray 401 can be held stably by engaging the recesses 431*a* and 432*a* of the right and left hands 431 and 432 with the flanges 401*a*. Legs 401*b* are formed at the bottom of each tray 401. When the tray 401 is stacked, the legs 401*b* is fitted into the inner wall of the tray 410 immediately below the former or into fitting holes of the stage 410 and 420.

Two insertion holes (a pair of right and left holes) 401*c* into which the base portions 391 of the cup 390 fitted to the lens LE are disposed inside the tray 401. An ID tag 402 as an identifier to which a work number is registered is provided to the side surface of each tray 401 and an ID tag reader 440 reads the work number thereof. Incidentally, a bar code may be used for identifying the work number.

Figure 7:
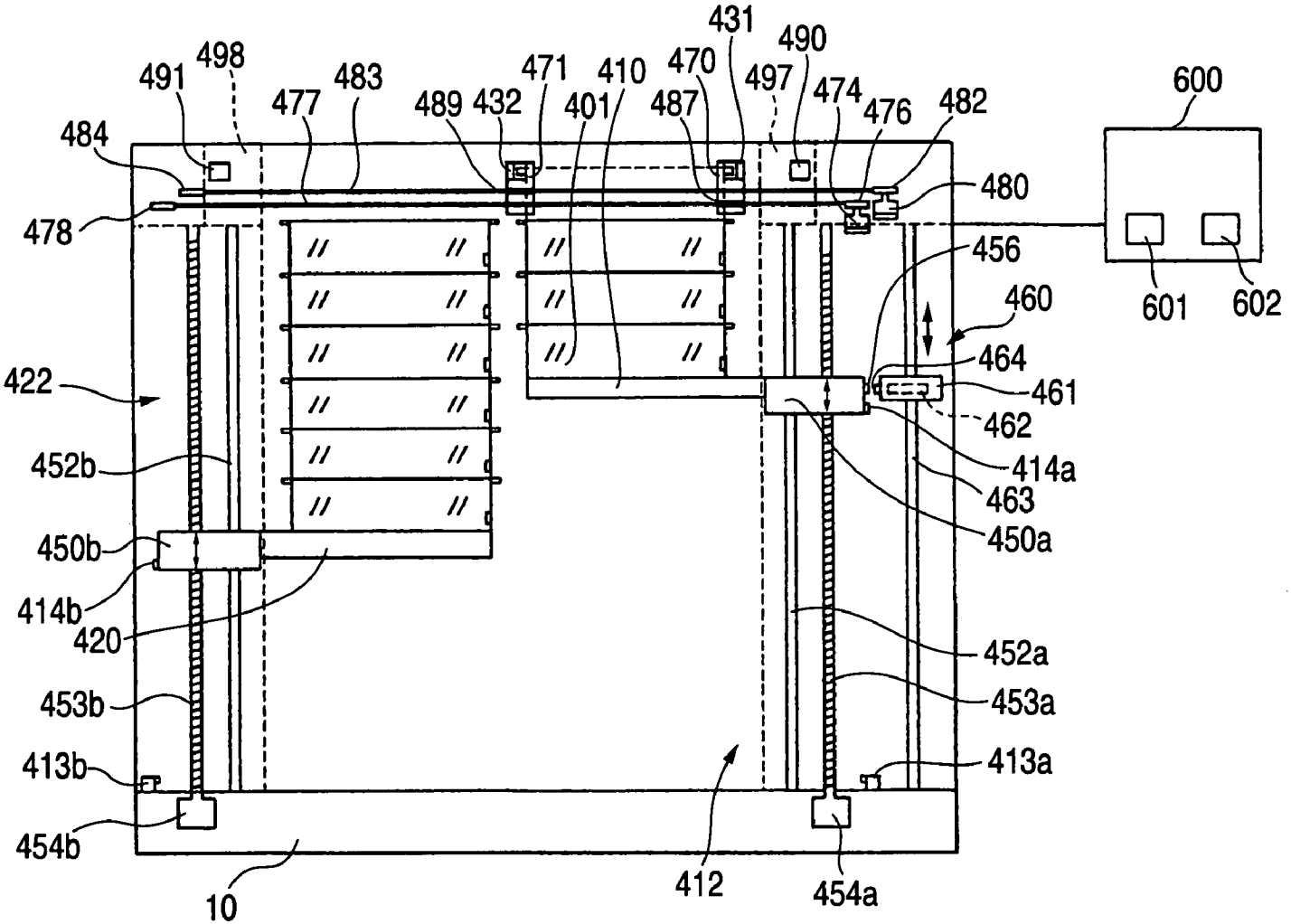
FIG. 7 is a schematic sectional view useful for explaining a vertical movement mechanism portion of a stage and a height adjustment mechanism portion of the stage.

FIG. 7 is a schematic sectional view of the vertical movement mechanism portion 412 and the height adjustment mechanism portion 460 of the stage 410. The stage 410 is horizontally attached to a stage base 450*a* that can move up and down along a guide shaft 452*a* extending vertically. A feed screw 453*a* interconnected to a pulse motor 454*a* and extending vertically meshes with the base 450*a*. As the motor 454*a* is driven and rotated, the stage 410 moves up and down with the base 450*a*. An origin sensor 413*a* is disposed at the lowermost position to which the base 450*a* can move. By sensing a shading plate 414*a* provided to the base 450*a*, the origin sensor 413*a* senses whether or not the stage 410 exists at the lowermost reference position. The system control portion 600 detects the height of the stage 410 on the basis of the detection result of the sensor 413*a* and the pulse quantity applied to the motor 454*a*. Incidentally, the height of the stage 410 may be detected by fitting an encoder to the motor or by using a linear encoder.

In the similar fashion of the vertical movement mechanism portion 412, the vertical movement mechanism portion 422 of the stage 420 includes a stage base 450*b* to which the stage 420 is horizontally fitted, a guide shaft 452*b*, a feed screw 453*a*, a pulse motor 454*b*, an origin sensor 413*b*, a shading plate 414*b*.

The height adjustment mechanism portion 460 is disposed so that the operator can adjust the height of the stage 410 as the operator desires. An adjustment base 461 that can move along a guide shaft 463 extending vertically is interconnected to the knob 462 which is exposed outside. The base 461 includes a stage detection portion 464 for detecting a reflecting plate 456 provided to the base 450*a*. The stage detection portion 464 includes a light emission portion such as an LED and a light reception portion such as a photo diode. When the light emitted from the light emission portion are reflected by the reflecting plate 456 and are received by the light reception portion, a detection signal is transmitted to the system control portion 600. Consequently, the detection whether or not the stage 410 exists at the position (height) set by the knob 462 can be made.

Incidentally, since the height adjustment information of the stage 420 can use the height adjustment information on the stage 410 side, the height adjustment mechanism portion 460 is disposed on only the stage 410 side. Needless to say, a similar height adjustment mechanism portion 460 may well be disposed on the stage 420 side.

Figure 8:
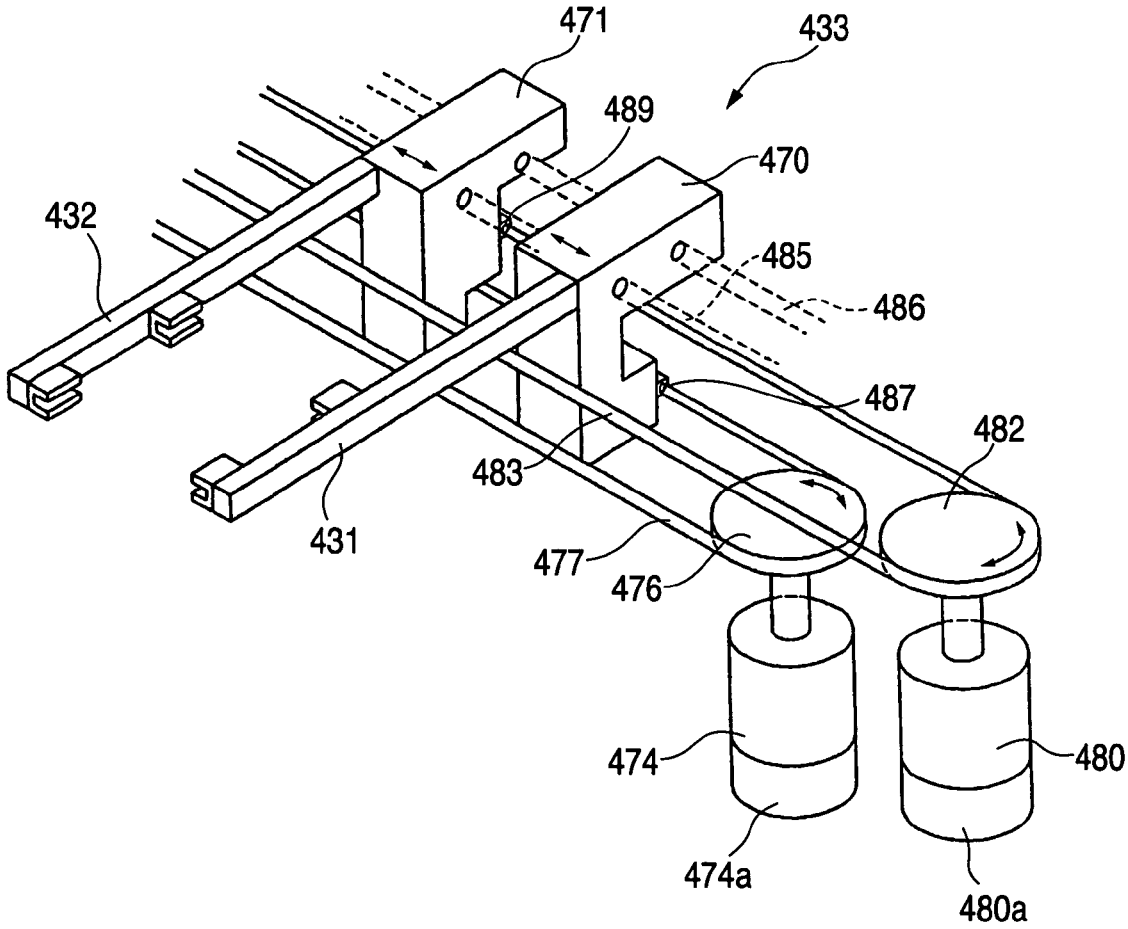
FIG. 8 is a schematic structural view of a transverse movement mechanism portion of the hand portion.
Figure 9:
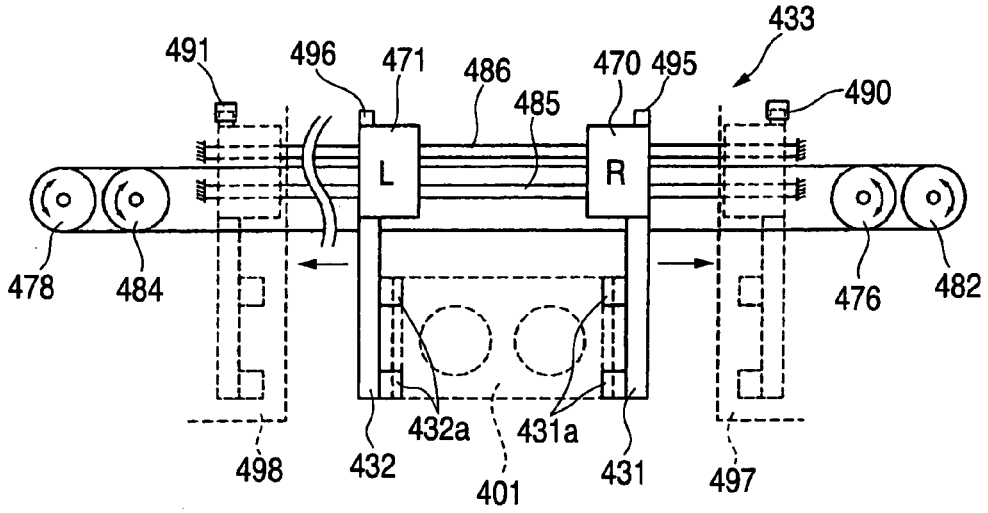
FIG. 9 is a schematic structural view of the transverse movement mechanism portion of the hand portion.

FIGS. 8 and 9 are schematic structural views of the transverse movement mechanism portion 433 of the hand portion 430. The transverse movement mechanism portion 433 includes a motor 474 for moving the right hand 431 and a motor 480 for moving the left hand 432. Encoders 474*a* and 480*a* are fitted to the rotary shafts of the motors 474 and 480, respectively. A pulley 476 fitted to the rotary shaft of the motor 474 is connected to a pulley 478 disposed at the left through a belt 477. A right hand base 470 to which the right hand 431 is fixed is fixed to the belt 477 at a belt fixing portion 487. As the motor 474 is driven and rotated, the right hand base 470 is guided by guide shafts 485 and 486 and is moved to the right and left. A pulley 482 fitted to the rotary shaft of the motor 480 is connected to a pulley 484 disposed at the left through a belt 483. A left hand base 471 to which the left hand 432 is fixed is fixed to the belt 483 at a belt fixing portion 489. As the motor 480 is driven and rotated, the left hand base 471 is guided by the guide shafts 485 and 486 and is moved to the right and left.

Incidentally, the base 470 has a recessed shape at an intermediate portion of its depth for fear that the belt 483 for moving the left hand 432 interferes with the base 470 as shown in FIG. 8. On the other hand, the base 471 has a recessed shape at a lower portion of its depth for fear that the belt 477 for moving the right hand 431 interferes with the base 471.

An origin sensor 490 detects a shading plate 495 provided to the right hand 431 and the system control portion 600 acquires the reference position of the right hand 431 from the output signal from the sensor 490. An origin sensor 491 detects a shading plate 496 provided to the left hand 432 and the system control portion 600 acquires the reference position of the left hand 432 from the output signal from the sensor 491. The right hand 431 and the left hand 432 can move to refuge positions inside covers 497 and 498, respectively.

The operation of the processing system 1 described above will be explained primarily about the stocking apparatus 400. Order data from each optician's shop is inputted to the host PC 602 through a communication system such as the Internet. The work number is applied to each order data and is registered to the ID tag 402 put to the tray 401 accommodating the lens LE. Each tray 401 accommodates a pair of right and left lenses LE with front side refraction surfaces (convex surfaces) facing up.

Before putting the tray 401 onto the stage 410, the operator moves up and down the knob 462 and sets the stage 410 to operator desired height. When the stage is set to the height of the waist, the operator can put the tray 401 without bending the waist.

When a set button 601 provided to the system control portion 600 is pushed, a drive signal is output to the motor 454*a* and the stage 410 moves up. Driving of the motor 454*a* is stopped when the stage detection portion 464 positioned at the height set by the knob 462 detects the reflecting plate 456 of the base 450*a*. The system control portion 600 stores the height of the stage 410 at this time into its memory. The height of the stage 410 can be managed as the number of pulses of the motor 454*a* when the state 410 is moved from the reference position to the stop position. Owing to the movement of the stage 410, the operator can put the trays 401 that are put one upon another onto the 410 at the convenient height.

After the preparation of the trays 401 is completed, the operator pushes a start button 602 provided to the system control portion 600 and executes processing of the processing system 1. The system control portion 600 moves down the stage 410 to the lowermost reference position by the motor 454*a*. The stage 410 is thereafter moved up again. When the tray detection portion 403 detects the uppermost tray 401, driving of the motor 454*a* is stopped and ascension of the stage 410 is stopped.

Next, the system control portion 600 drives the motors 474 and 480, respectively, and moves the right hand 431 and the left hand 432, that have been under the standby state at the cover portions, in the mutually approaching direction so that the right hand 431 and the left hand 432 can hold (clamp) the tray 401 on the stage 410. The positions of the right and left hands 431 and 432 for holding the tray 401 are set in advance and the control portion 600 controls the moving positions of the right and left hands 431 and 432 on the basis of the output signals from the encoders 474*a* and 480*a*. Incidentally, when the tray 401 is held, a smaller driving current than the driving current on the side of the motor 474 is applied to the motor 480 so as to push the left hand 432 to the left side surface of the tray 401. In consequence, the tray 401 can be held by stable holding force.

The work number of the tray 401 of the uppermost stage is read by the ID tag reader 440 and is inputted to the system control portion 600. The system control portion 600 sends data of lens processing corresponding to the work number to the processing apparatus 100.

To first process the lens LE for the right eye, the system control portion 600 operates the RH device unit 200. The RH device 200 moves along the movement path 30, sucks the lens LE to the sucking portion 222, conveys the lens LE and puts it to the blocking device 300. When the blocking device 300 thereafter operates, the cup 390 is attached to the surface of the lens LE.

After fitting of the cup 390 is completed, the RH device 200 again operates and conveys the lens LE having the cup 390 attached thereto to the processing apparatus 100. The lens LE is set to the chuck shaft 112 while its cup 390 side facing down. The third arm 220 of the RH device 200 is thereafter released from the processing apparatus 100 and the processing apparatus 100 processes the lens LE.

During processing of the lens LE for the right eye, the RH device 200 is driven to prepare processing of the lens LE for the left eye accommodated in the tray 401 and the lens LE for the left eye is conveyed to the blocking device 300. After the blocking device 300 finishes fitting of the cup 390, the lens LE is returned to the tray 401 for the next processing.

After the processing apparatus 100 finishes processing of the lens LE for the right eye, the RH device 200 returns the tray 401 to its original position. The lens LE for the left eye is thereafter conveyed to the processing apparatus 100. When processing is similarly finished, the lens LE is returned to the original position of the tray 401.

When processing of the right and left lenses LE is completed, the system control portion 600 drives the motors 474 and 480 and moves the tray 401 accommodating the processed lenses LE toward the stage 420 while the tray 401 is held by the hands 431 and 432. The movement positions of the hands 431 and 432 are detected by the encoders 474*a* and 480*a*, respectively. The vertical movement mechanism portion 422 moves up the stage 420 to the position at which the tray 401 can be received and receives the tray 401. As the hands 431 and 432 move in the mutually departing direction and open a little, the tray 401 is put on the stage 420.

The system control portion 600 moves the hands 431 and 432 toward the stage 410 and lets the tray 401 accommodating the next unprocessed lens LE enter the standby state. The vertical movement mechanism portion 412 moves up the stage 410 and the next tray 401 is positioned at the detection position of the tray detection portion 403. The hands 431 and 432 thereafter hold the tray 401 and processing of the lenses LE accommodated in the tray 401 is serially executed in the same way as described above.

Figure 10:
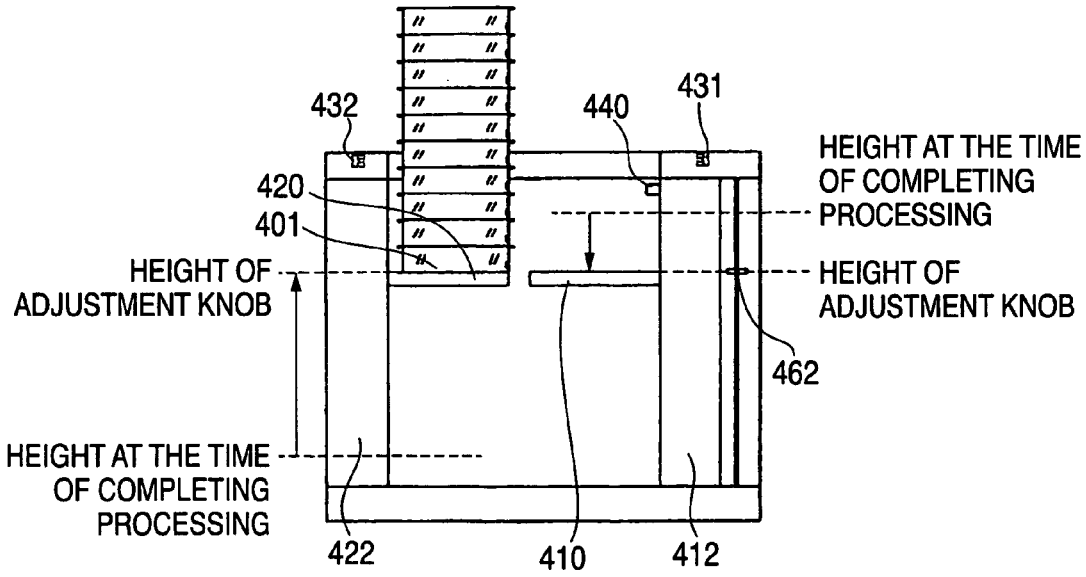
FIG. 10 is an explanatory view for explaining height adjustment of the stage.

When the processing steps described above are repeated to process all the lenses LE and the trays 401 are all moved to the stage 420, the system control portion 600 moves the right hand 431 to the refuge position inside the cover 497 on the right side and the left hand 432, to the refuge position inside the left cover 498. The system control portion 600 then generates a movement completion signal of the trays 401, calls the height information of the stage 410 (420) stored in the memory 501 on the basis of this signal input and moves the stage 420 to the height stored in the memory 601 as shown in FIG. 10. Incidentally, the system control portion 600 drives the motor 454*b* of the vertical movement mechanism portion 422 so that the height of the stage 420 reaches at this time the same height (height information set by the adjustment knob 462) as the height when the trays 401 are mounted to the stage 410. Consequently, the operator can easily take out the trays 401 at the desired height in the same way as when putting the trays 401 onto the stage 410. Because the right hand 431 and the left hand 432 are retreated to the positions that do not hinder the operation, the operator can easily remove the trays 401.

The system control portion 600 calls out the height information from the memory 601 on the basis of the input of the movement completion signal of the trays 401 and moves the stage 410 so that the stage 410 can reach the same height. The operator can therefore put the tray 401 accommodating the new unprocessed lenses LE to the stage 410 placed at the position easy for the putting operation. When a new operator who replaces the operator changes the height of the stage 410, the new operator adjusts the knob 462 to his desired height and pushes the set button 601. The height of the stage 410 can be thus changed.

Figure 11:
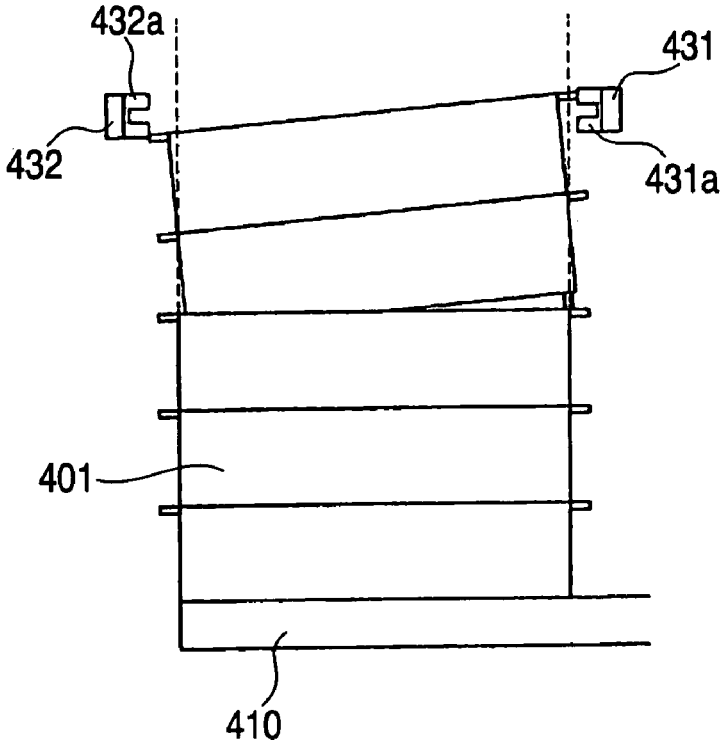
FIG. 11 shows trays stacked on the stage while some of them are inclined.

In the construction described above in which a plurality of trays 401 is aligned in the vertical construction and is put on the stage 410, there is the case where some of the trays 401 at the intermediate position deviate either transversely or vertically as shown in FIG. 11 and the trays are stacked while inclining. When the operator is not aware of this condition and executes as such each process step, troubles such as drop and breakage are likely to occur when the trays 401 are moved by the hand portion 430 or when the lenses LE are adsorbed by the RH device 200.

This system can detect abnormality of the holding state of the trays 401 by the right and left hands 431 and 432 and the putting state of the trays 401. The holding positions of the trays 401 by the right and left hands 431 and 432 are detected by the output signals from the encoders 474*a* and 480*a*, and the movement positions of the right and left hands 431 and 432 when the trays 401 are normally aligned in the vertical direction are set in advance. When the trays 401 are inclined as shown in FIG. 11, the movement positions of the right and left hands 431 and 432 deviate from positions at which they exist normally. When the recess 431*a* of the right hand 431 does not fit to the flange 401*a* of the tray 401, the movement position of the right hand 431 deviates from the position at which it normally exists. When this positioning error does not fall within a predetermined allowable range, the system control portion 600 regards that placement and holding of the trays 401 are abnormal, stops the operation of the system and at the same time, displays an error message to raise warning. This warning may be made by sound. Owing to this warning, the operator can take countermeasure such as correction of the putting state of the trays 401 and can prevent in advance the possible troubles. Such abnormality may as well be detected by disposing a touch sensor inside a cavity of each recess 431*a,* 432*a* and by detecting that the recess 431*a,* 432*a* does not fit to the flange 401*a* of the tray 401.

The embodiment described above uses the height adjustment mechanism portion 460 for positioning the height of the stage 410 (420) when the trays 401 are put but may also use the following construction. For example, a switch for moving up and down the stage 410 (420) is provided to the system control portion 600 so that the motor 454*a* (454*b*) is rotated when the switch is operated and the stage 410 (420) moves up and down. After setting the stage 410 (420) to the desired height, the operator pushes the set button 601 and stores the height information in the memory. Consequently, the height information can be called out from the memory at the time of exchange of the trays 410 and the stages 410 and 420 can be adjusted in the same way as described above. It is also possible to store in advance the desired height of each operator in the memory and to operate the lens stocking apparatus at the stage height stored when the data of the operator is inputted through an ID card, or the like.

Figure 12:
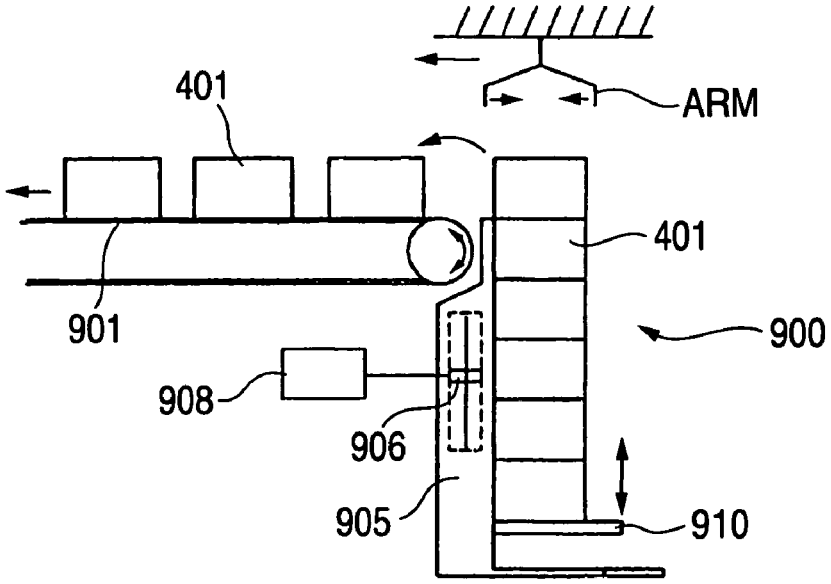
FIG. 12 is an explanatory view useful for explaining a stocking apparatus using a conveyor as a receiving stage.

In the explanation given above, the stocking apparatus 400 has the stage 410 for transferring and the stage 420 for receiving but may be a stocking apparatus 900 shown in FIG. 12 that uses a belt conveyor 901 as a receiving or transferring stage. This stocking apparatus 900 includes a stage 910 for aligning vertically the trays 410, a vertical movement mechanism portion 905 for moving up and down the stage 910, a height adjustment mechanism portion having a adjustment knob 906 for setting the height of the stage 910 to an arbitrary position in the same way as described above and a control portion (unit) 908 for controlling each of these constituent elements. Also in this case, when the height of the stage 910 is set to a desired height of the operator through the knob 906, the trays 410 can be easily put.

What is claimed is:

1. A lens stocking apparatus for stocking a plurality of lenses comprising:

a first stage and a second stage, each of which is capable of stacking a plurality of lens accommodating trays in a vertical direction;

vertical movement mechanism portions which move the first and second stages in the vertical direction, respectively; and a tray transferring unit which transfers the trays from the first stage to the second stage, wherein the tray transferring unit includes a right hand and a left hand for holding the tray, each of which is capable of independently moving in a transverse direction wherein when the tray is to be transferred from the first stage to the second stage, the tray transferring unit moves the right and left hands in a mutually approaching direction to hold the tray, moves the right and left hands in a direction from the first stage to the second stage to transfer the held tray, and moves the first and second hands in a mutually departing direction to release the held tray.

2. The lens stocking apparatus according to claim 1, wherein the tray transferring unit includes a first transverse movement mechanism portion having a first motor for moving the right hand in the transverse direction and a second transverse movement mechanism portion having a second motor for moving the left hand in the transverse direction.

3. The stocking apparatus according to claim 1 further comprising a height adjustment unit which adjusts a height of at least one of the first and second stages in the vertical direction.

4. The stocking apparatus according to claim 3, wherein the height adjustment unit includes a setting unit which sets a height and the vertical movement mechanism portion moves at least one of the first and second stages in the vertical direction on the basis of the set height.

5. The stocking apparatus according to claim 4, wherein the height adjustment unit includes a storage unit which stores the set height, and the vertical movement mechanism portion moves at least one of the first and second stages on the basis of the stored height.

6. The stocking apparatus according to claim 1 further comprising a detection unit which detects abnormality of a holding state or putting state of said trays.

7. A lens processing system including the stocking apparatus according to claim 1, comprising:

a lens processing apparatus (100); and a lens conveying device (200) which conveys the lenses between the stocking apparatus and the processing apparatus.

8. A lens stocking apparatus for stocking a plurality of lenses comprising:

a stage which is capable of stacking a plurality of lens accommodating trays in a vertical direction;

a setting unit which sets a height of the stage in the vertical direction; and a vertical movement mechanism portion which moves the stage in the vertical direction on the basis of the set height.

9. The lens stocking apparatus according to claim 8 further comprising a storage unit which stores the set height, wherein the vertical movement mechanism portion moves the stage on the basis of the stored height.

10. A lens processing system having the lens stocking apparatus according to claim 8, comprising:

a lens processing apparatus; and a lens conveying device which conveys the lenses between the stocking apparatus and the processing apparatus.

* * * * *